United States Patent [19]

Sougawa

[11] Patent Number: 4,554,896

[45] Date of Patent: Nov. 26, 1985

[54] FUEL CONTROL SYSTEM FOR INTERNAL COMBUSTION ENGINES

[75] Inventor: Masafumi Sougawa, Shizuoka, Japan

[73] Assignees: Yamaha Hatsudoki Kabushiki Kaisha; Sanshin Kogyo Kabushiki Kaisha, both of Japan

[21] Appl. No.: 487,697

[22] Filed: Apr. 22, 1983

[30] Foreign Application Priority Data

May 1, 1982 [JP] Japan ..... 57-72573

[51] Int. Cl.[4] ..... F02M 1/16

[52] U.S. Cl. ..... 123/179 G; 123/179 R; 123/187.5 R

[58] Field of Search ..... 123/179 G, 179 L, 179 R, 123/187.5 R

[56] References Cited

U.S. PATENT DOCUMENTS

| | | | |
|---|---|---|---|
| 2,905,165 | 9/1959 | Hall | 123/179 G |
| 3,371,658 | 3/1968 | Turner | 123/187.5 R |
| 3,704,702 | 12/1972 | Aono | 123/179 G |
| 3,805,758 | 4/1974 | May | 123/187.5 R |
| 4,032,071 | 6/1977 | Imota | 123/117 A |
| 4,068,800 | 1/1970 | Doberty | 123/117 A |
| 4,204,489 | 5/1980 | Onishi | 123/179 L |
| 4,284,040 | 8/1981 | Baltz et al. | 123/179 L |
| 4,286,553 | 9/1981 | Baltz et al. | 123/187.5 R |
| 4,309,968 | 1/1982 | DuBois | 123/187.5 R |
| 4,373,479 | 2/1983 | Billingsley et al. | 123/187.5 R |
| 4,375,206 | 3/1983 | Baltz et al. | 123/187.5 R |

FOREIGN PATENT DOCUMENTS

| | | | |
|---|---|---|---|
| 2746461 | 4/1979 | Fed. Rep. of Germany | 123/179 G |
| 53-37216 | 4/1978 | Japan . | |
| 1447389 | 8/1976 | United Kingdom | 123/187.5 R |

*Primary Examiner*—Ira S. Lazarus
*Assistant Examiner*—R. S. Bailey
*Attorney, Agent, or Firm*—Ernest A. Beutler

[57] ABSTRACT

A cold enrichment device for an internal combustion engine having a pair of parallel flow paths communicating with the engine for delivering cold enrichment fuel. One of the flow paths includes a valve that is responsive to starting of the engine for delivering fuel for a predetermined time period whereas the other flow path includes a temperature responsive valve for providing cold running enrichment fuel.

17 Claims, 2 Drawing Figures

FUEL CONTROL SYSTEM FOR INTERNAL COMBUSTION ENGINES

BACKGROUND OF THE INVENTION

This invention relates to a fuel control system for internal combuston engines and more particularly to an improved cold starting and warm up fuel control for such engines.

As is well known, it is desirable, if not necessary, to provide additional fuel to an internal combustion engine to assist in its cold starting. In addition to providing additional fuel for cold starting, additional fuel should also be provided when the engine is cold during its warm up operation. The amount of fuel required for warm up is, however, less than that necessary for starting. Various devices have been proposed for achieving cold starting and cold running enrichment. One type of device normally employed for this purpose is a choke valve which is disposed in the intake system of the engine carburetor and which may be operated to provide cold starting and cold running enrichment. The use of choke valves, however, have a number of disadvantages. The choke valve per se does not always provide the desired degree of enrichment for all starting and running conditions. The provision of a choke valve in the induction system also causes a restriction to the flow, at times when choke operation is not necessary. Therefore, the use of the choke valve, even though it is fully opened, may restrict the maximum power output of the engine. Furthermore, if multiple carburetors are employed, it is necessary to provide some interlinking between the choke valves of the various carburetors so that they will all be operated in unison.

Another form of cold starting and cold running enrichment device is the provision of a separate starter system that provides additional fuel during cold starting and/or cold running. Such starter systems also are not fully satisfactory because they are incapable of providing both the necessary degree of enrichment for starting and a proper running mixture during cold warm up. In addition, where multiple carburetors are employed, it is also desirable to interlink the starting systems associated with each carburetor which, as aforenoted, can cause undue complication.

It is, therefore, a principal object of this invention to provide an improved device for cold starting and cold running.

It is a further object of the invention to provide an improved enrichment device for cold operation that will provide stable engine speed during the warm up cycle.

It is a further object of this invention to provide an improved and simplified cold starting and cold running enrichment device for multiple cylinder engines.

SUMMARY OF THE INVENTION

This invention is adapted to be embodied in a cold enrichment device for an internal combustion engine that includes a fuel pump, means responsive to starting of the engine for delivering fuel under pressure from the fuel pump to the engine for a predetermined period of time for starting enrichment. In addition, temperature responsive means are incorporated for delivering fuel under pressure from the fuel pump to the engine when the temperature of the engine is below a predetermined amount for cold running enrichment.

DETAILED DESCRIPTION OF THE PREFERRED EMBODIMENT

Figure 1:
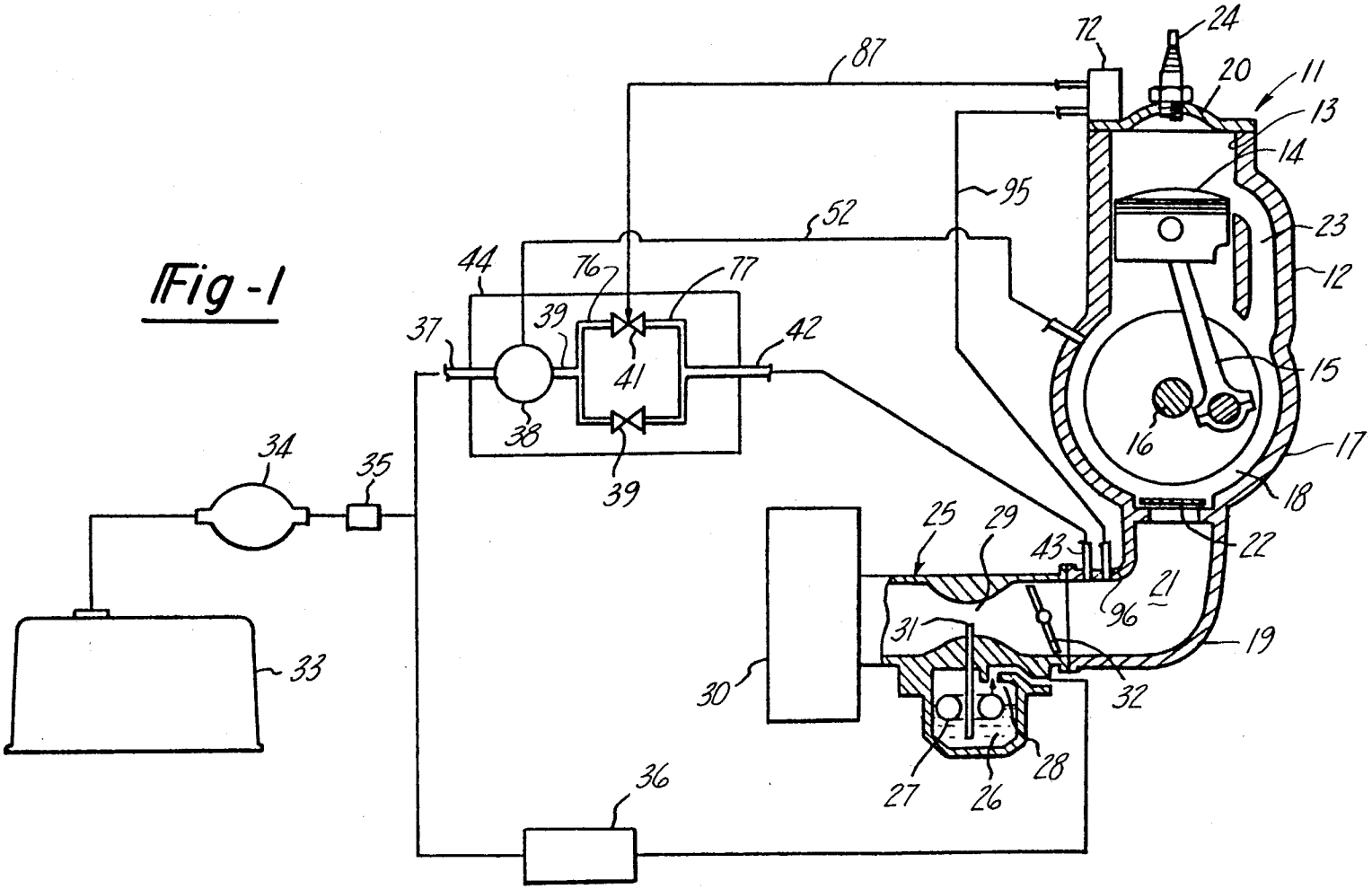
FIG. 1 is a partially schematic, cross-sectional view taken through the single cylinder of a multiple cylinder internal combustion engine constructed in accordance with an embodiment of the invention.

Referring first to FIG. 1, a two-cycle internal combustion engine constructed in accordance with an embodiment of the invention is identified generally by the reference numeral 11. The engine 11 is particular adapted for use in outboard motors and has a plurality of cylinders, although only one cylinder is shown in FIG. 1 in cross-section. The engine 11 is of the crankcase compression type and includes a cylinder block 12 having a cylinder bore 13 in which a piston 14 is supported for reciprocation. The piston 14 is connected by means of a connecting rod 15 to a crankshaft 16 that is journaled in a crankcase 17 of the engine in a known manner. A cylinder head 20 is affixed to the cylinder block 12.

The crankcase 17 defines a sealed chamber 18 for each cylinder to which an intake charge is delivered from an intake manifold 19 having respective induction passages 21. The induction passages 21 communicate with the crankcase chambers 18 through reed type check valves 22 so as to permit a charge to enter the chamber 18 when its volume is increasing and so as to prevent reverse flow.

The compressed charge is transferred from the crankcase chambers 18 to the area above the pistons 14 by means of scavenge passages 23. The charge transferred to the area above the pistons 14 is fired by means of spark plugs 24 that are supported in the cylinder head 20. The burnt charge is discharged from the cylinder bores 13 in a known manner through exhaust ports (not shown).

A fuel/air mixture is delivered to the manifold induction passages 21 by means of suitable charge forming devices. In the illustrated embodiment, the charge forming devices may comprise a carburetors of a conventional type, indicated generally by the reference numeral 25. In a preferred embodiment of the invention, there is a carburetor 25 provided for each cylinder 13. The carburetor 25 includes a fuel bowl 26 in which fuel is maintained at a uniform head by means of a float 27 that operates an inlet valve 28 in a known manner. Fuel is discharged from the fuel bowl 26 into a venturi section 29 of the carburetor 25 by means of a main fuel discharge nozzle 31. A throttle valve 32 is positioned downstream of the venturi section 29 for controlling the speed of the engine in a known manner. Since the carburetor 25 is conventional in construction, specific details of its construction and operation are not given and are believed to be well within the scope of those skilled in the art.

An air silencer 30, which also may be of any known type, is positioned upstream of the carburetors 25 for silencing the intake air in a suitable manner.

A remote fuel tank 33 is provided for containing the fuel on which the engine 11 operates. In view of the fact that the illustrated embodiment is an outboard motor, the fuel tank 33 may be conveniently positioned within the hull of the associated watercraft. A manually operated pump 34 is provided for drawing fuel out of the fuel tank 33 for delivery to the engine. The pump 34 may be of any known type such as one of the well known bulb type pumps used for this purpose. Manually operated fuel pump 34 delivers fuel through a fuel filter 35 to a main fuel pump 36. The main fuel pump 36 may be of the type driven by the engine such as a diaphragm pump that operates in response to pressure variations within the crankcase chambers 18. Alternatively, the pump 36 may be an electrically driven type or any other known type of pump used for this purpose. The pump 36 delivers fuel to the fuel bowl 26 through the aforedescribed needle valve 28 under the operation of the float 27. The construction of the engine and fuel system thus far described is convention and generally forms no part of the invention.

In addition to supplying fuel to the main fuel system including the main pump 36, the manually operated pump 34 and filter 35 supply fuel to a cold starting and cold enrichment system constructed in accordance with the invention. The cold starting and cold enrichment system includes an inlet conduit 37 that feeds an auxiliary pump 38. The auxiliary pump 38 discharges to a pair of parallel conduits. A starting enrichment valve 39 is positioned in one of these conduits and a cold running enrichment valve 41 is positioned in the other conduit. The parallel conduits in which the valves 39 and 41 are interposed discharge through a common line 42 into a discharge nozzle 43 for each of the manifold intake passages 21. The pump 38 and valves 39 and 41 may be conveniently combined within a single housing, which is shown schematically and which is identified by the reference numeral 44.

Figure 2:
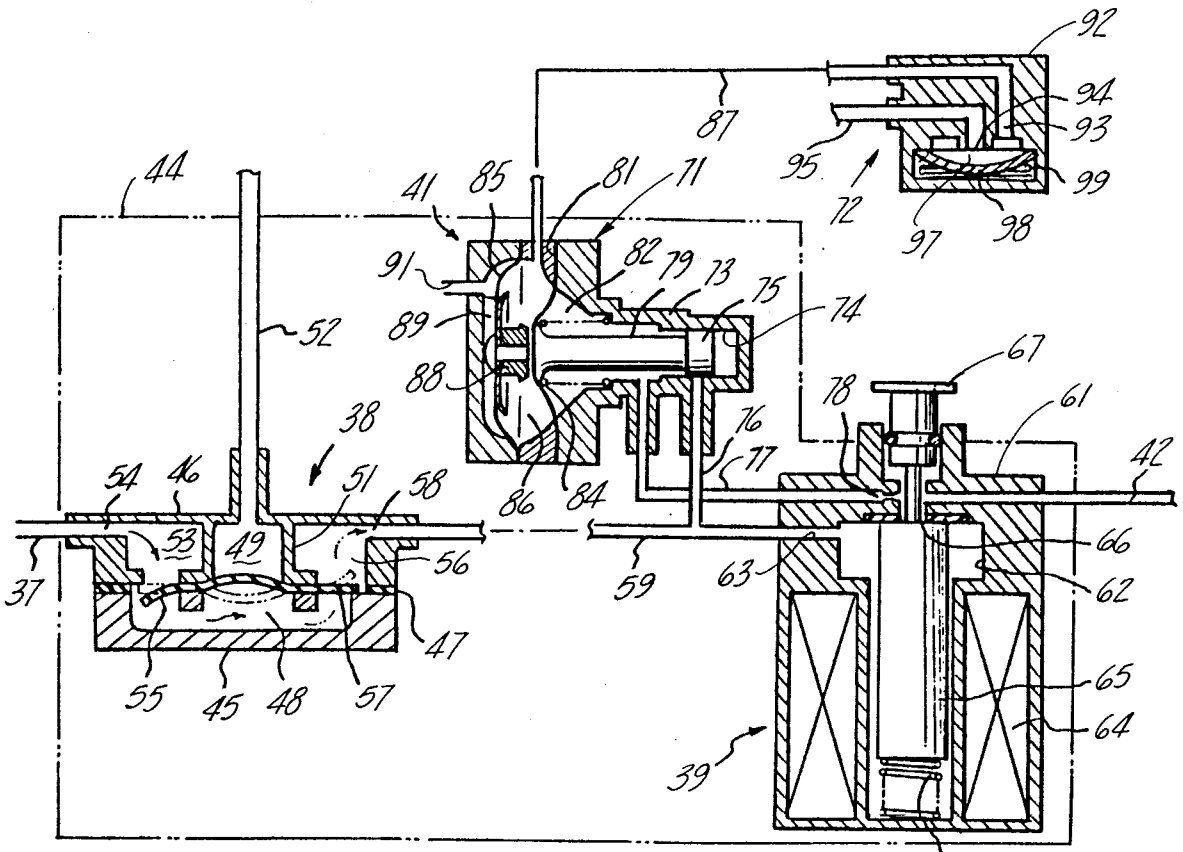
FIG. 2 is an enlarged cross-sectional view showing the cold starting and cold running enrichment device of the engine.

Referring now primarily to FIG. 2, the auxiliary pump 38 consists of an outer housing made up of a lower piece 45 and an upper piece 46 between which a diaphragm 47 is clamped. A pumping chamber 48 is defined beneath the diaphragm 47 and a cavity formed by the lower piece 45. A vacuum actuating cavity 49 is positioned above the diaphragm 47 and is defined by a cylindrical wall 51 of the upper piece 46. The actuating cavity 49 communicates with the crankcase chamber 18 by means of a conduit 52 so that variations in pressure in the crankcase chamber 18 will effect changes in pressure in the cavity 49 so as to operate the pump 32 in a manner to be described.

The upper piece 46 defines an inlet chamber 53 to which fuel may flow from the conduit 37 through an inlet port 54. The diaphragm 47 is formed with an inlet check valve portion 55 that will permit fuel to flow from the inlet chamber 53 into the pumping chamber 48 but which prevents reverse flow.

A discharge chamber 56 is also formed by the upper piece 46 and a discharge check valve 57 formed integrally with the diaphragm 47 permits flow from the pumping cavity 48 to the discharge chamber 56. A discharge port 58 communicates the discharge chamber 57 with a delivery conduit 59.

During running of the engine or cranking of it, the pressure in the crankcase chamber 18 will sequentially vary. This pressure variation is transmitted to the cavity 49 so as to alternately cause the diaphragm 47 and specifically its central portion to move between the solid line position as shown in FIG. 2 when the pressure in the crankcase cavity 18 is at a minimum and a distended position as shown in dot-dash line when the pressure in the crankcase cavity 18 is at its maximum. Hence, the volume in the pumping cavity 48 will vary so as to cause fuel to sequentially flow into the cavity 48 through the inlet check valve 55 and be discharged from the cavity 48 through the discharge check valve 57.

The cold starting control valve 39 includes an outer housing 61 that defines an inlet chamber 62. The conduit 59 supplies fuel to the inlet chamber 62 through an inlet port 63. A solenoid winding 64 is positioned within the housing 61 and encircles an armature 65. The armature 65 extends through the inlet cavity 62 and has a portion that cooperates with a seat 66 so as to control the communication of the chamber 62 with the cold starting enrichment conduit 42. A manually operated plunger 67 is also coupled to the armature 65 for actuating the armature downwardly so as to open the valve seat 66 and permit fuel to flow from the chamber 62 to the cold starting enrichment conduit 42. A coil compression spring 68 is positioned beneath the armature 65 so as to normally urge the armature into engagement with the valve seal 66 and prevent this communication.

A suitable control circuit is provided for the solenoid winding 64 so as to energize this winding for a period of time when the starter associated with the engine 11 is actuated. Upon the initiation of the starting cycle, the solenoid winding 64 will be engaged for a period of time so as to draw the armature 65 downwardly and permit cold starting enrichment through opening of the valve seat 66. Alternatively, the cold starting enrichment may be provided manually by the operator depressing the plunger 67 for a desired period of time.

The cold running enrichment valve 41 includes an auxiliary valve assembly, indicated generally by the reference numeral 71, and a temperature responsive valve, indicated generally, by the reference numeral 72. Referring first to the valve 71, it comprises an outer housing assembly consisting of a cylinder portion 73 having a bore 74 in which a valve spool 75 is slidably supported. A branch passage 76 intersects the passage 59 and the bore 74. The spool 75 normally closes the branch passage 76. To the left of the spool 75 there is formed a discharge branch passage 77 that communicates with a passage having a restricted opening 78 formed in the housing 61 of the cold starting enrichment valve 39. The passage in which the restricted opening 78 is formed communicates with the cold starting enrichment conduit 42 and bypasses the cold starting valve consisting of the valve seat 66.

The valve spool 75 is connected to a stem 79 which is, in turn, affixed to a first diaphragm 81 that is contained within the housing of the auxiliary valve 71. The diaphragm 81 defines a fuel chamber 82 that is positioned on the downstream side of the valve spool 75. A coil compression spring 84 is contained within the cavity 82 and acts upon the valve stem 79 so as to urge the diaphragm 81 and valve spool 75 to the left so as to normally close the inlet passage 76.

A second diaphragm 85 is positioned within the housing of the auxiliary control valve 71 and with the diaphragm 81 defines an intermediate vacuum chamber 86. The vacuum chamber 86 receives a signal from a conduit 87 which, in turn, communicates with the thermally responsive valve 72 in a manner to be described.

The diaphragm 85 carries an actuating plunger 88 that extends within the vacuum chamber 86 and which is adapted to engage the diaphragm 81 on occasion, as will be described.

An atmospheric chamber 89 is formed on the left hand side of the second diaphragm 85 and communicates with the atmosphere through an atmospheric port 91.

It should be noted that the construction of the auxiliary control valve 71 is such that the first diaphragm 81 has a smaller effective area exposed to the vacuum chamber 86 than the second diaphragm 85. Hence, when a vacuum signal is present in the chamber 86, the diaphragm 85 will cause a force to be exerted through the plunger 88 on the diaphragm 81 so as to compress the spring 84 and shift the valve spool 75 to the right so that the passages 76 and 77 will communicate with each other. As a result of this, cold running enrichment fuel will be delivered to the conduit 42.

The temperture responsive valve 72 includes an outer housing 92 that is mounted in heat exchanging relationship with an appropriate portion of the engine 11 that is indicative of its temperature such as the cylinder head 18 as shown in FIG. 1. The housing 92 has a signal port 93 that communicates with the vacuum conduit 87 that supplies the vacuum signal to the chamber 86 of the auxiliary control valve 71. In addition, an inlet port 94 is formed in the housing 92 that communicates with a conduit 95 that provides a vacuum signal from the induction manifold passage 21 from a suitable sensing port 96 (FIG. 1).

The ports 93 and 94 communicate with a chamber 97 in which a bimetallic valve disc 98 is positioned. The valve disc 98 is engaged on its underside by means of a coil compression spring 99. The valve disc 98 is a bimetal wafer and is adapted to move between a low temperature position as shown in FIG. 2 to a high temperature position wherein it wharps to a flattened condition so that the spring 99 can urge it into engagement with the ports 93 and 94 and close off their communication. If the temperature at which the valve disc 98 will so wharp can be set at any appropriate level, for example, five degrees centigrade. When the temperature is below five degrees centrigrade, the ports 93 and 94 will communicate with each other through the chamber 97. Above this temperature, the communication is stopped by the wharpage of the disc 98 and the action of the coil spring 99.

OPERATION

The figures of the drawings illustrate the engine as it appears before it is running and assuming that the temperature of the cylinder head as sensed by the temperature responsive valve 72 is below that required to cause the bimetallic valve disc 98 to wharp. That is, the figures illustrate the condition as it appears when an engine is to be cold started.

The operator actuates the manually actuated pump 34 so as to deliver fuel through the fuel filter 35 to the main fuel pump 36. At the same time, fuel will be delivered to the conduit 37 and auxiliary pump 38. The pressurization of the fuel by the manually operated pump 34 will cause fuel to flow past the inlet check valve 55 of the auxiliary pump 38 and past the discharge check valve 57 to the starting valve chamber 62. Once the starting operation is initiated, the solenoid 64 will be actuated for a period of time through the aforedescribed time circuit and the armature 65 will move away from the valve seat 66 so as to permit the pressurized fuel to flow to the conduit 42 for discharge into the induction passages 21 through the nozzles 43. When the engine is cranked, the pump 38 will also be actuated so as to continue to supply pressurized fuel for starting.

Alternatively, manual depression of the plunger 67 will also provide cold starting enrichment as aforedescribed.

Under either cold starting enrichment method, a fuel enrichment in addition to the normal charge provided by the carburetors 25 will be supplied to the crankcase chambers 18 so as to assist cold starting enrichment. Once the engine beings to run, there will be a reduced pressure exerted in the manifold induction passages 21 that is transmitted to the conduit 95 and through the temperature responsive valve 92 to the conduit 87. Hence, a vacuum will be exerted in the chamber 86 of the auxiliary control valve 71. Atmospheric pressure will act in the atmospheric chamber 89 and urge the diaphragm 85 to the right as viewed in FIG. 2. The plunger 88 will contact the diaphragm 86 and also urge it and the valve spool 75 to the right. This will uncover the passage 76 and permit the passages 76 and 77 to communicate with each other so that supplemental cold running enrichment fuel will be delivered through the restricted opening 78 to the cold starting enrichment conduit 42. Hence, further enrichment will be provided and will be continued even when the cold starting enrichment valve 39 moves to its closed position. Hence, there will be good enrichment for cold running and an even speed of the engine can be maintained.

As the engine gradually heats up, the thermally responsive valve member 98 will eventually be heated above the temperature at which it wharps. At this time, the spring 99 will urge the valve member 98 upwardly so as to close the communication between the ports 93 and 94. Hence, the chamber 86 will no longer receive a vacuum signal and the spring 84 will act upon the diaphragm 86 so as to urge it and the valve spool 75 to the left. This will then close the communication between the passages 76 and 77 and the cold running enrichment will be terminated.

Since the auxiliary fuel pump 38 and valves 71 and 39 are positioned within a common casing 44, a relatively simple arrangement may be provided that will permit good cold starting and cold running enrichment. Although in the illustrated embodiment the main and auxiliary fuel pumps 36 and 38 are separate from each other, it should be readily apparent that the invention may be used in conjunction with an arrangement wherein only a single fuel pump is employed. Such a single fuel pump should have two separate discharge passages, one to the carburetor 25 and the other to the cold starting system including the cold starting enrichment valve 39 and the cold running enrichment valve 41. Also, the cold starting and cold running enrichment need not be provided through a nozzle 43 that discharges into the manifold passaes 21, but may be accomplished through a system that discharges directly into the crankcase chambers 18. Alternatively, the cold starting enrichment and cold running enrichment may be discharge directly into the scavenge passages 23. Other changes and modifications from those described may also be made without departing from the spirit and scope of the invention, as defined by the appended claims.

I claim:

1. A cold enrichment device for an internal combustion engine comprising a charge forming device having a main nozzle for delivering a fuel/air mixture to said engine for running, a fuel pump, a discharge nozzle downstream of said main nozzle, means responsive to starting of the engine for delivering fuel under pressure from said fuel pump to said discharge nozzle for a predetermined period of time for starting enrichment, and temperature responsive means for delivering fuel under pressure from said fuel pump to said discharge nozzle independently of said charge forming device when the temperature of the engine is below a predetermined amount for cold running enrichment.

2. A cold enrichment device for an internal combustion engine as set forth in claim 1, further including manually operable means for manually actuating the starting responsive means for providing selective, manual starting enrichment.

3. A cold enrichment device as set forth in claim 2 wherein the charge forming device comprises a carburetor.

4. A cold enrichment device as set forth in claim 2 wherein the starting responsive means and the temperature responsive means define parallel fuel flow paths to the discharge nozzle.

5. A cold enrichment device as set forth in claim 4 wherein the fuel pump comprises a pump responsive to pressure variations within the engine.

6. A cold enrichment device as set forth in claim 5 wherein there are a pair of fuel pumps in series and one of the fuel pumps comprises a manually operated pump.

7. A cold enrichment device as set forth in claim 2 wherein the starting responsive means comprises a valve having a control member movable in response to starting of the engine and manually operable to provide communication between an inlet port and a discharge port.

8. A cold enrichment device as set forth in claim 7 further including a temperature responsive valve for operating the temperature responsive means.

9. A cold enrichment device as set forth in claim 8 wherein the temperature responsive valve is operative to control a vacuum signal from the engine for operating a vacuum responsive valve in response to temperatures below a predetermined temperature.

10. A cold enrichment device as set forth in claim 1 wherein the starting responsive means and the temperature responsive means define parallel fuel flow paths to the discharge nozzle.

11. A cold enrichment device as set forth in claim 10 wherein the fuel pump comprises a pump responsive to pressure variations within the engine.

12. A cold enrichment device as set forth in claim 11 wherein there are a pair of fuel pumps in series and one of the fuel pumps comprises a manually operated pump.

13. A cold enrichment device as set forth in claim 12 wherein the starting responsive means comprises a valve having a control member movable in response to starting of the engine to provide communication between an inlet port and a discharge port.

14. A cold enrichment device as set forth in claim 13 further including a temperature responsive valve for operating the temperature responsive means.

15. A cold enrichment device as set forth in claim 14 wherein the temperature responsive valve is operative to control a vacuum signal from the engine for operating a vacuum responsive valve in response to temperatures below a predetermined temperature.

16. A cold enrichment device as set forth in claim 13 wherein the valve element is manually operative.

17. A cold enrichment device as set forth in claim 1 wherein the charge forming device comprises a carburetor.

* * * * *